US005960511A

United States Patent [19]

Boyce

[11] Patent Number: 5,960,511

[45] Date of Patent: Oct. 5, 1999

[54] SPLATTER SHIELD FOR PAINT ROLLER

[76] Inventor: Carl J. Boyce, P.O. Box 455, King George, Va. 22485

[21] Appl. No.: 09/078,266

[22] Filed: May 13, 1998

[51] Int. Cl.[6] ..... B05C 17/02; B05C 21/00

[52] U.S. Cl. ..... 15/248.2; 15/230.11

[58] Field of Search ..... 15/230.11, 248.1, 15/248.2; 401/15, 197; 492/13, 19

[56] References Cited

U.S. PATENT DOCUMENTS

| | | | |
|---|---|---|---|
| 2,902,706 | 9/1959 | Gaetke | 15/248.2 |
| 3,457,582 | 7/1969 | Fisher | 15/248.2 |
| 3,654,658 | 4/1972 | Kovacs | 15/248.2 |
| 3,685,084 | 8/1972 | Bennett | 15/230.11 |
| 3,748,683 | 7/1973 | Smith et al. | 15/248.2 |
| 3,790,984 | 2/1974 | Spransy et al. | 15/248.2 |
| 4,063,325 | 12/1977 | Lizak | 15/230.11 |
| 4,091,493 | 5/1978 | Weiss | 15/248.2 |
| 4,254,529 | 3/1981 | Cooke | 15/230.11 |
| 4,337,002 | 6/1982 | Martucci | 401/15 |
| 4,566,816 | 1/1986 | Janssen | 401/219 |
| 4,667,363 | 5/1987 | Calvert | 15/248.2 |
| 4,696,072 | 9/1987 | Cormack et al. | 15/248.2 |
| 4,765,353 | 8/1988 | Rhoades | 134/138 |
| 4,821,362 | 4/1989 | Kolb | 15/248.2 |
| 5,400,459 | 3/1995 | Jarecke et al. | 15/230.11 |

FOREIGN PATENT DOCUMENTS

| | | | |
|---|---|---|---|
| 547401 | 11/1959 | Belgium | 15/248.2 |
| 3424335 | 1/1986 | Germany | 15/230.11 |

*Primary Examiner*—Mark Spisich
*Attorney, Agent, or Firm*—Chase & Yakimo, L.C.

[57] ABSTRACT

A splatter shield for connection to a conventional paint roller handle assembly includes a shield having a hemispherical top wall and parallel end walls for confining paint splatter or dripping during paint rolling. Opposing ends of the shield are releasably attached to the shaft portion of the paint roller handle assembly with one end of the shaft engaging a hub assembly releasably connected to an end of the roller pad assembly and shield. This structure allows for rotation of the roller pad about the longitudinal shaft axis. The splatter shield further includes an adjustment arm assembly having first and second arms, the first arm being centrally pivotably attached to the shield and second arm being pivotably attached to the handle. First and second arms are further slidably joined together with friction type fasteners such that lengthening or shortening the span of the adjustment arms causes the shield end walls to rotate about the shaft and to a desired position about the paint roller pad, the desired position being maintained by tightening the fasteners.

18 Claims, 7 Drawing Sheets

SPLATTER SHIELD FOR PAINT ROLLER

BACKGROUND OF THE INVENTION

This invention relates to paint roller shields and, more particularly, to an improved splatter shield having an adjustment means which will not become clogged with paint and which allows a user to orient the shield about a paint roller without touching the shield proper.

Splatter associated with roller painting can be significantly reduced or at least confined by a paint roller splatter shield. Accordingly, various devices have been proposed in the prior art for shielding a user or surrounding surfaces from paint splatter.

Although assumably effective in operation, such known devices exhibit various functional limitations. Some forms of the splatter shield, such as U.S. Pat. Nos. 4,254,529, 3,748,683, and 4,063,325 to Cooke, Smith, and Lizak, respectively, are not easily adaptable to all conventional paint rollers. Another variation is disclosed in U.S. Pat. No. 4,821,362 to Kolb which is adjustable by grasping and rotating the shield itself to a desired position. However, as paint accumulates on the edges of the paint shield, either from splatter during use or while repeatedly loading the roller in a paint tray, a user's hands become fouled with paint while adjusting the position of the shield. Further, most adjustable splatter shield devices have adjustment mechanisms located on or near the end caps of a paint roller. The adjustment mechanisms thereby become clogged with paint while repeatedly loading the roller in a paint tray, particularly if the shield is not thoroughly cleaned following each use.

It is therefore desirable to have an improved paint roller splatter shield which can be oriented about any conventional offset arm paint roller without a user touching any portion of the shield during adjustment. It is also desirable to have an improved splatter shield having adjustment means which will not become clogged during paint rolling or loading of the roller.

SUMMARY OF THE INVENTION

In response thereto, I have invented an improved splatter shield which utilizes a shield and adjustment arm assembly attached to a conventional paint roller handle assembly. Opposing ends of the shield are pivotably attached to the shaft of the paint roller handle assembly and a hub assembly connected to one end of the paint roller shaft and shield, respectively. A first adjustment arm is centrally attached to the shield and slidably cooperates with a second adjustment arm to adjust the overall length of the arms which in turn orients the shield relative to the paint roller pad depending on the angle of the surface being painted. The first arm is slidably joined to the second arm with a friction type fastener such that lengthening or shortening the span of the adjustment arms causes the shield to rotate to a desired position about the paint roller without the need for the user to touch the shield. The position of the shield relative to the roller pad may then be maintained by tightening the fasteners.

It is therefore a general object of this invention to provide a splatter shield which can be oriented about a paint roller pad for confining the splatter of paint during paint rolling.

Another object of this invention is to provide a splatter shield, as aforesaid, having a separate adjustment mechanism which orients the shield proper which will not become clogged with paint during use.

Still another object of this invention is to provide a splatter shield, as aforesaid, which can be adjusted by a user without the need to touch the paint covered shield.

A further object of this invention is to provide a splatter shield, as aforesaid, which is adaptable for use with a conventional paint roller handle assembly.

A still further object of this invention is to provide a splatter shield, as aforesaid, which is easily attachable and detachable from a conventional paint roller handle assembly.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
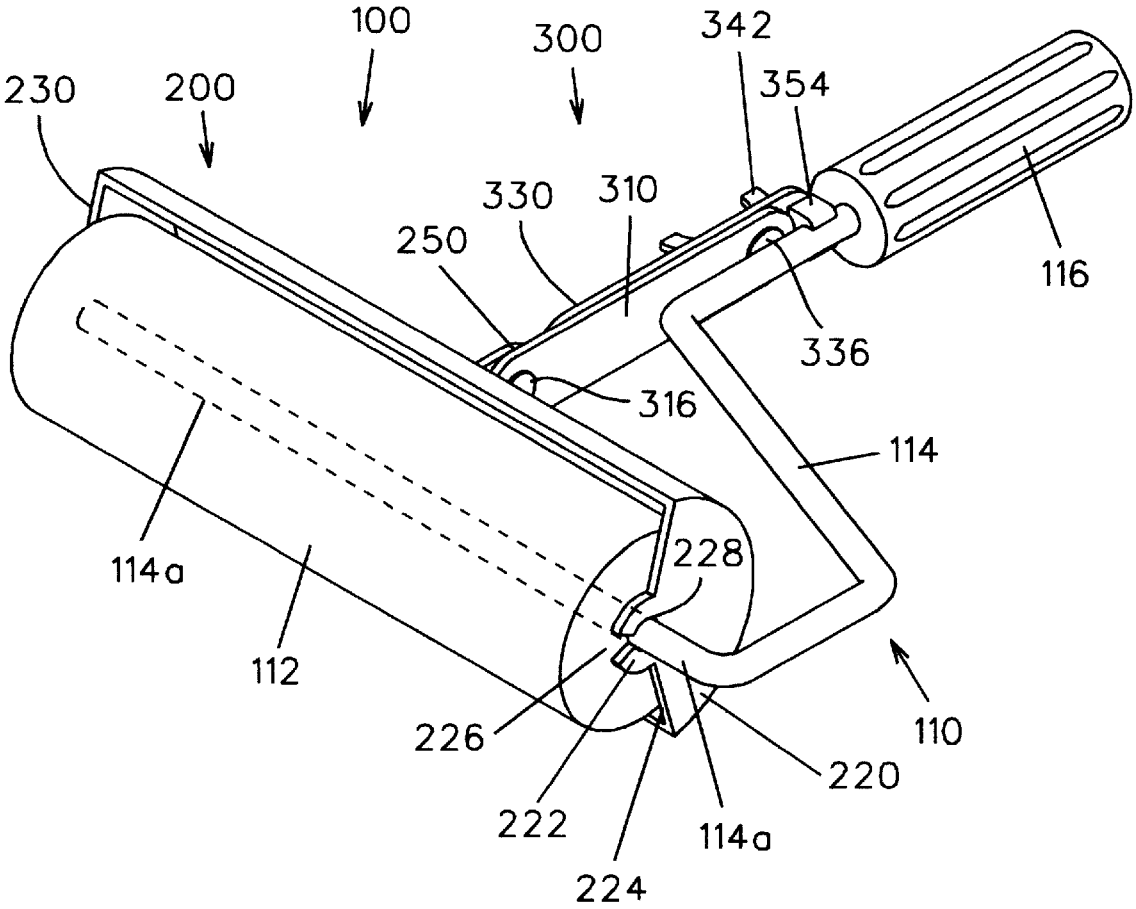
FIG. 1 is a front perspective view of the splatter shield attached to a paint roller handle assembly, the adjustment arms being at a fully retracted position.
Figure 2:
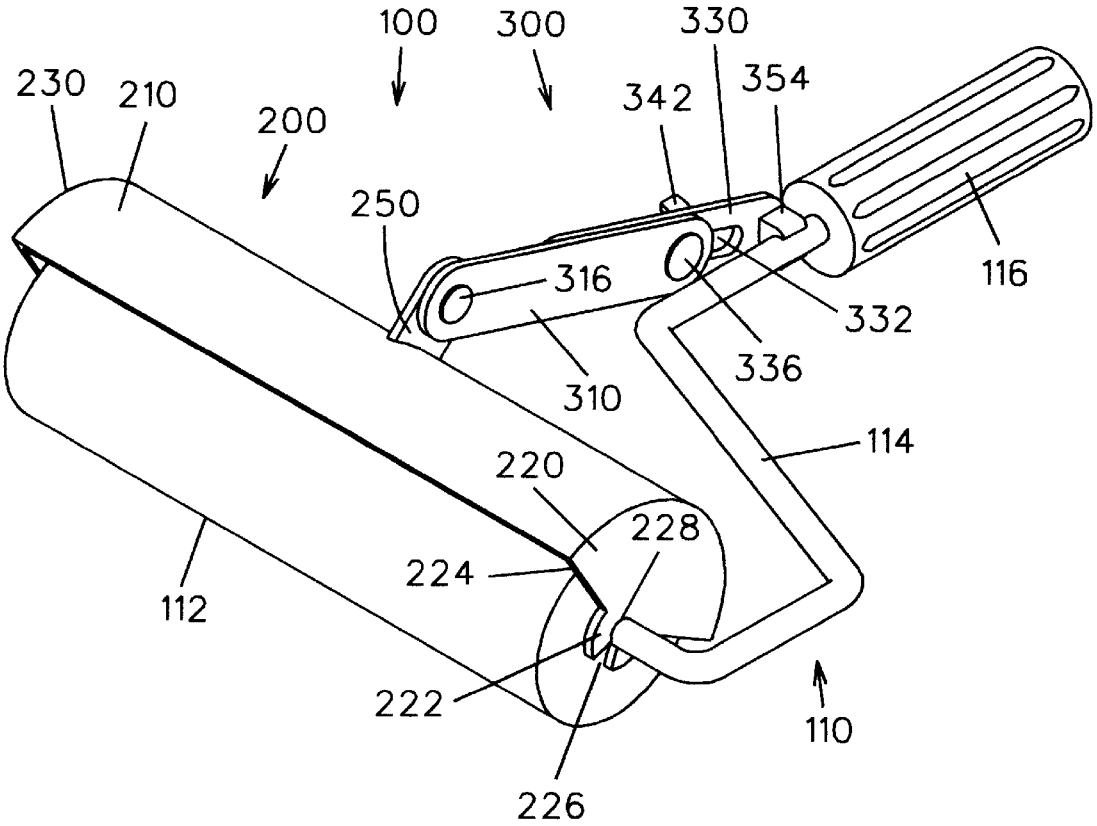
FIG. 2 is a front perspective view of the splatter shield shown in FIG. 1, the adjustment arms being partially extended.

Turning more particularly to the drawings, FIGS. 1 and 2 show the splatter shield assembly 100 comprising a paint shield 200 and adjustment arm assembly 300 releasably attached to a conventional paint roller handle apparatus 110. The paint roller apparatus 110 comprises a roller pad assembly 112 rotatably attached in conventional manner to an offset shaft 114*a* extending from roller arm 114 as shown in phantom lines in FIG. 1. The roller arm 114 is then attached to a handle 116.

The paint shield 200 comprises a generally hemispherical top wall 210, a first end wall 220, and a second end wall 230. Shield 200 prevents paint from splattering onto the user or surrounding surfaces during paint rolling. First end wall 220 includes a tab/flange 222 integrally joined to an inner edge 224 thereof, the tab/flange 222 having notch 226 which communicates with a centrally disposed circular aperture 228 therein. The tab/flange 222 is preferably made of flexible material suitable for snappable attachment to the offset shaft 114*a* of a paint roller handle apparatus 110. It is understood that the tab/flange 222 is pivotable about the offset arm shaft 114*a* as the shield 200 is oriented thereabout, as to be described later.

Figure 3:
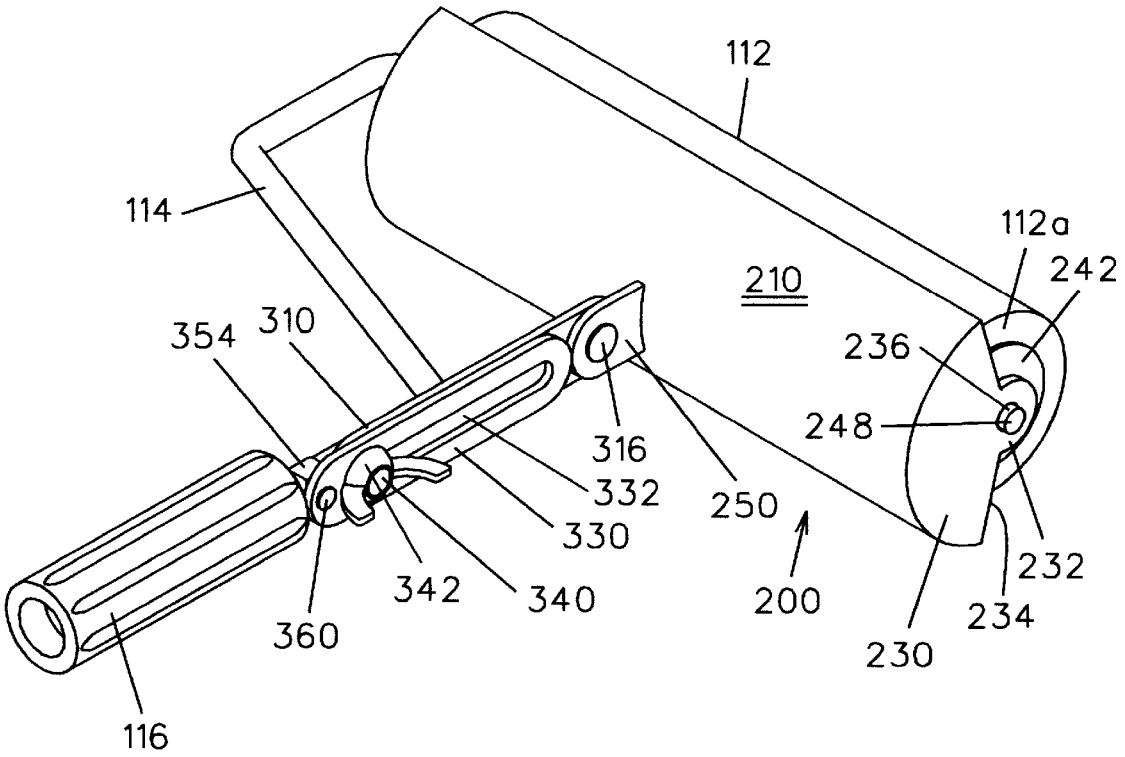
FIG. 3 is a rear perspective view of the splatter shield shown in FIG. 1.
Figure 4:
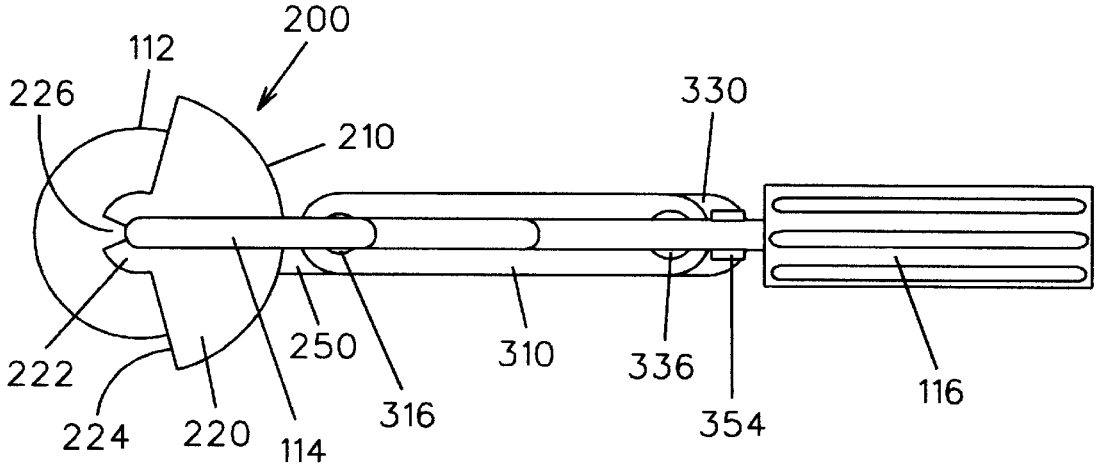
FIG. 4 is a right side view of the splatter shield shown in FIG. 1.
Figure 5:
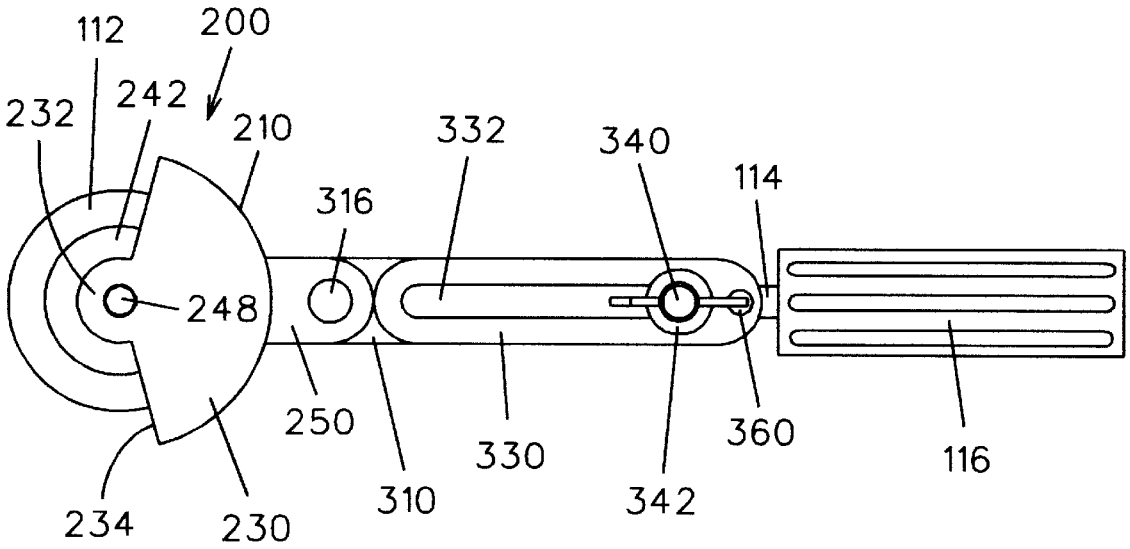
FIG. 5 is a left side view of the splatter shield shown in FIG. 1.
Figure 7:
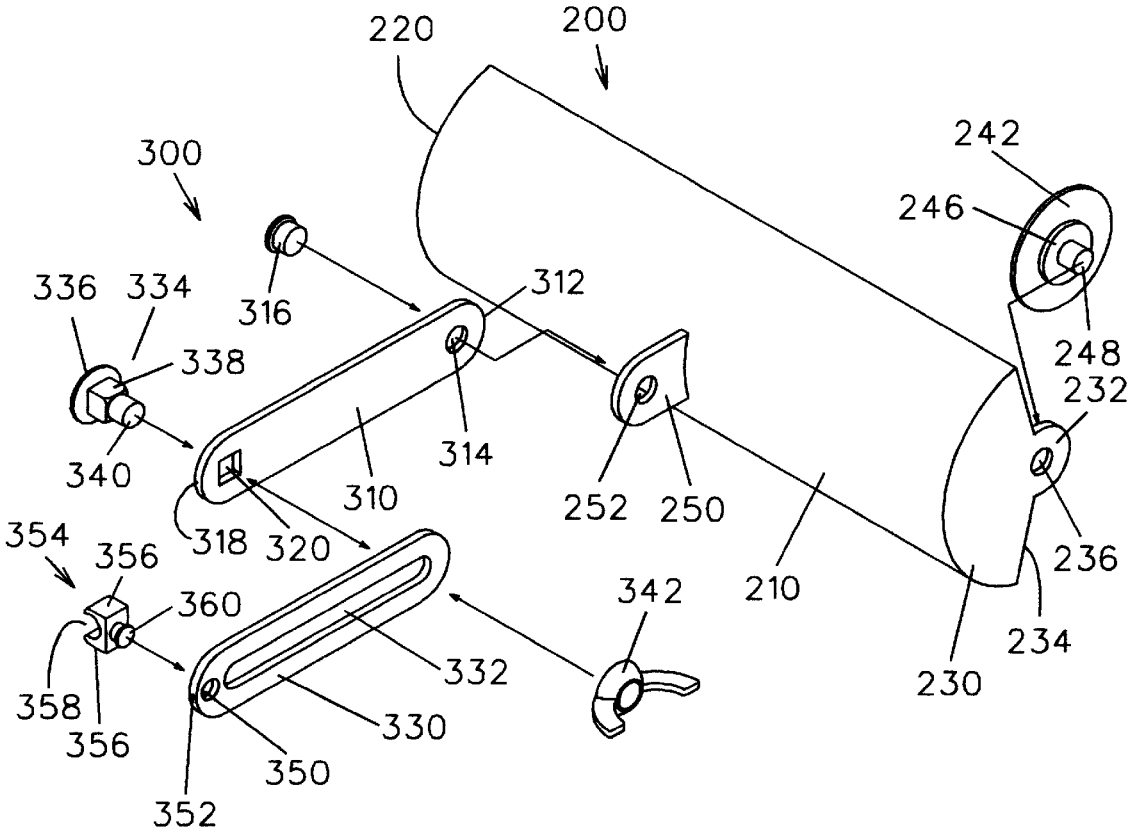
FIG. 7 is an exploded rear view of the splatter shield.
Figure 8:
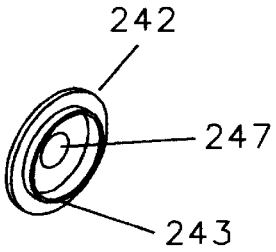
FIG. 8 is a perspective view of the hub assembly.

As shown in FIGS. 3 and 7, second end wall 230 includes a tab/flange 232 integrally joined to an inner edge 234 thereof, the tab/flange 232 having an aperture 236 therethrough for pivotably securing a hub assembly thereto. The hub assembly (FIGS. 7, 8), preferably made of singular molded construction, includes an end plate 242 having a concentric rim 243 integrally attached to an interior side thereof which frictionally engages the recess found in an end wall of a paint roller pad 112. A washer 246 is integrally attached to the exterior side of the end plate 242, the washer 246 being integrally attached to a hub 248 which is secured to the tab/flange 232 by insertion of the hub 248 through the aperture 236 therein. The free end of roller shaft 114*a* extends through end plate aperture 247 and seats within hub 248 extending therefrom. Thus, the hub assembly releasably secures one end wall 230 of the shield 200 about the paint roller assembly shaft 114*a* while allowing free rotation of the roller pad 112 and assembly. The snap attachment of the opposed end wall 220 of shield 200 to the shaft 114*a* secures the opposite end wall about the paint roller assembly 112. This structure provides pivot points for the shield 200 about roller shaft 114*a* which extends through the roller pad 112.

The top wall 210 of the shield 200 includes a centrally disposed tab/flange 250 having an aperture 252 therethrough for attachment of an adjustment arm assembly 300 thereto, the tab/flange 250 being normal to the top wall 210 and parallel to end walls 220, 230 (FIG. 7).

The adjustment arm assembly 300 includes first and second arms 310, 330 which cooperate to adjust the position of the shield 200 relative to the paint roller assembly 112. The first arm 310 presents a circular aperture 314 displaced from a first end 312 thereof which registers with the aperture 252 in tab/flange 250 of the shield 200 for pivotably securing first arm 310 thereto with a rivet 316. Thus, a pivot axis is provided for the first adjustment arm 310. The first arm 310 further presents an opposed square shaped aperture 320 displaced from a second end 318 thereof, the aperture 320 registering with an elongated slot 332 substantially spanning the length of the second arm 330. The first and second arms 310, 330 are thereby releasably joined together in a friction fit arrangement by passing male/female fasteners 334, 342, e.g. a bolt/nut combination or the like, through the aperture 320 and slot 332 and tightening the same. The male fastener 334 may be in the form of a carriage bolt having a round head 336, square neck 338, and round threaded shank 340 such that the bolt extends through the aligned aperture 320 and slot 332. Thus, the second arm 330 is slidable relative to the round shank 340 of the bolt extending within the slot 332, while the square neck 338 of the bolt within the aperture 320 prevents pivotal rotation of first and second arms 310, 330 thereabout. The female fastener 342 would be in the form of a wing nut or the like.

The second arm 330 further presents an aperture 350 sandwiched between the slot 332 and one end 352 thereof for securing a bracket 354 thereto with a rivet 360, the rivet 360 providing a pivot axis for the adjustment arm assembly 300. The bracket 354 includes top and bottom walls 356 with an open annular cavity 358 therebetween for snappably attaching the adjustment arm assembly 300 to the offset arm 114.

Figure 6:
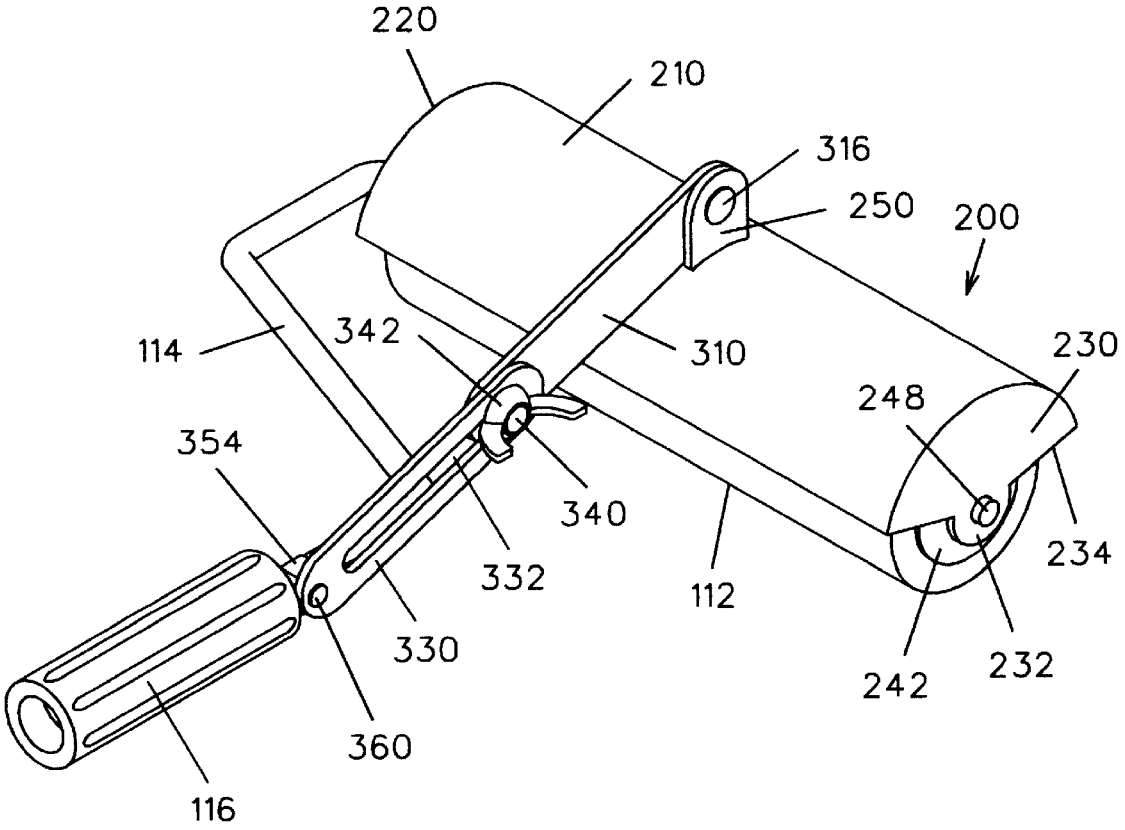
FIG. 6 is a rear perspective view of the splatter shield shown in FIG. 1, the adjustment arms being at a fully extended position.

The orientation of the shield 200 about the paint roller assembly 112 is thereby adjustable by loosening the fasteners 334, 342 to reduce pressure on first and second arms 310, 330, and-slidably lengthening or shortening the longitudinal relationship or degree of overlap between arms 310, 330 of adjustment arm assembly 300. As the extension of the arms 310, 330 of adjustment arm assembly 300 becomes longer the shield will rotate about the pivot points on shaft 114*a* from a FIG. 1 position towards the FIG. 6 position at which the arms 310, 330 are fully extended. It is noted that the end of arm 330 pivots about rivet 360 to enhance arm extension/shield 200 orientation. At the fully extended position the shield 200 is atop the roller 112. As the relative extension of the arms 310, 330 decreases, the shield 200 rotates towards the FIG. 1 position. During this movement a portion of the arm 114 is clamped within bracket 354. Thus, the movement of the arms 310, 330 is primarily transmitted to the shield, such that the shield 200 will pivot at each pivot point on shaft 114*a* as described above. This action causes the shield 200 to rotate about the roller assembly pad 112 only upon a selectable adjustment of the extension of arms 310, 330. Thus, the shield 200 can be oriented relative to pad 112 upon a selectable positioning of the extension of arms 310, 330.

Accordingly, it can be seen that the splatter shield can be selectively positioned about a conventional offset arm paint roller such that adjustment of the shield 200 may be accomplished without a user touching the shield proper. Further, the adjustment assembly of the splatter shield is not susceptible to becoming clogged with paint during loading or use as the hub assembly spaces the end wall 230 from the end 112*a* of the roller pad 112.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A splatter shield for a paint roller pad rotatably mounted about a shaft of a roller handle assembly comprising:

a shield, said shield comprising:

a main body having a configuration adapted for covering a portion of a paint roller pad;

first and second end walls at opposed ends of said main body, said end walls adapted for position adjacent opposed ends of the paint roller pad;

means on said end walls for mounting said end walls in movement about a shaft of a roller handle assembly extending through the paint roller pad, said mounting means positioning said end walls adjacent the ends of the roller pad and said main body along a portion of the roller pad between the pad ends;

a flange extending from said main body;

an aperture in said flange;

a first arm having first and second apertures therein, said first aperture in said first arm aligned with said flange aperture;

a pin extending through said aligned apertures to provide for pivotal movement of said first arm therearound;

a second arm;

a slot in said second arm;

a pin extending through said second aperture of said first arm and through said slot, said slot slidable along said pin extending therethrough whereby to relatively adjust the relative length of said first and second arms between a plurality of positions between a first position at which said first arm is at a maximum degree of overlap with said second arm and a second position at which said first arm is at a minimum degree of overlap with said second arm;

means for holding said first and second arms at a selectable relative position, said relative adjustment of said first and second arms urging said shield to pivot about said flange pin and said end walls about the shaft whereby to vary the relationship of said shield relative to the roller pad; and means on said second arm for clamping a portion of the paint roller handle thereto.

2. The shield as claimed in claim 1 wherein said clamping means comprises a bracket on said second arm for receiving a portion of the roller handle assembly therein.

3. The shield as claimed in claim 2 further comprising means for pivotally mounting said bracket to said second arm.

4. The shield as claimed in claim 1 further comprising a hub assembly, said hub assembly comprising:

an end plate;

means for mounting said end plate between one of said end walls and an end of the paint roller pad, said end plate receiving an end of the shaft therein for releasably securing said end wall to the end of the paint roller pad.

5. The shield as claimed in claim 4 wherein said mounting means comprises:

a rim on said end plate for nesting within the end of the roller pad;

an aperture in said end plate;

an aperture in one of said end walls;

a hub extending from said aperture in said end plate and through said aperture in said one of said end walls, said hub receiving an end of the shaft therein upon extension of the shaft through the roller pad and said end plate aperture.

6. A splatter shield for a paint roller pad rotatably mounted about a shaft of a roller handle assembly comprising:

a shield, said shield comprising:

a top wall having a configuration adapted for extension along a paint roller pad;

first and second end walls at opposed ends of said top wall;

means on said end walls for mounting said end walls in movement about a shaft of a roller handle assembly extending through the paint roller pad, said mounting means positioning said end walls adjacent ends of the paint roller pad and said top wall in said extension along the roller pad between the pad end walls;

a first arm;

means for pivotally mounting said first arm to said shield;

a second arm;

means for mounting said first arm to said second arm in a plurality of relative longitudinal relationships between a first position at which said arms present a minimum overall length and a second position at which said arms present a maximum overall length;

means for holding said first and second arms at a selectable longitudinal relationship, a movement of said first and second arms to said selectable relationship urging said first arm to pivot said shield about said end walls mounted to the shaft, whereby to adjust the relationship of said shield relative to said roller pad;

means on said second arm for clamping a portion of the paint roller handle assembly thereto.

7. The shield as claimed in claim 6 wherein said clamping means comprises a bracket on said second arm for receiving a portion of the roller handle assembly therein.

8. The shield as claimed in claim 7 further comprising means for pivotally mounting said bracket to said second arm.

9. The shield as claimed in claim 6 further comprising a hub assembly, said hub assembly comprising:

an end plate;

means for mounting said end plate between one of said end walls and an end of the paint roller pad, said end plate receiving an end of the shaft therein for releasably securing said end wall to the end of the paint roller pad.

10. The shield as claimed in claim 9 wherein said end plate mounting means comprises:

a rim on said end plate for nesting within the end of the roller pad;

an aperture in said end plate;

an aperture in said one of said end walls;

a hub extending from said aperture in said end plate and through said aperture in said one of said end walls, said hub receiving an end of the shaft therein upon extension of the shaft through the roller pad and said end plate aperture.

11. A splatter shield for a paint roller pad rotatably mounted about a shaft of a roller handle assembly comprising:

a shield, said shield comprising:

a top wall having a configuration adapted for extension along a paint roller pad;

first and second end walls at opposed ends of said top wall;

means on said end walls for mounting said end walls in movement about a shaft of a roller handle assembly extending through the paint roller pad, said mounting positioning said end walls adjacent ends of the paint roller pad;

an arm having first and second ends;

means for pivotally mounting said first arm end to said shield;

means for mounting said second arm end to a portion of the roller handle assembly;

means for adjusting the length of said arm between a first position at which said arm presents a minimum length and a second position at which said arm presents a maximum length;

means for maintaining said arm at a selectable length, a movement of said arm to said selectable length urging said shield end walls to pivot about the shaft, whereby to adjust the relationship of said shield relative to the roller pad; and means at a second end of said arm for clamping a portion of the paint roller handle assembly thereto.

12. The shield as claimed in claim 11 wherein said length adjusting means comprises:

first and second arms comprising said arm;

means for slidably mounting said first arm to said second arm at a plurality of selectable positions between a first position at which an overall length of said first and second arms corresponds to said minimum length and a second position at which said overall length of said first and second arms corresponds to said maximum length, said maintaining means holding said first and second arms in a position wherein said overall length of said first and second arms corresponds to said selectable position.

13. The shield as claimed in claim 11 wherein said clamping means comprises a bracket on said arm for receiving a portion of the roller handle assembly therein.

14. The shield as claimed in claim 13 further comprising means for pivotally mounting said bracket to said arm.

15. The shield as claimed in claim 11 further comprising a hub assembly, said hub assembly comprising:

an end plate;

means for mounting said end plate between one of said end walls and an end of the paint roller pad, said end plate receiving an end of the shaft therein for releasably securing said end wall to the end of the paint roller pad.

16. The shield as claimed in claim 15 wherein said mounting means comprises:

a rim on said end plate for nesting with an end of the roller pad;

an aperture in said end plate;

an aperture in said one of said end walls;

a hub extending from said aperture in said end plate and through said aperture in one of said end walls, said hub receiving an end of the shaft therein upon extension of the shaft through the roller pad and said end plate aperture.

17. The shield as claimed in claim 11 wherein said end wall mounting means comprises an aperture in said end walls for extension of the shaft therethrough.

18. The shield as claimed in claim 17 further comprising a slot in each of said end walls and communicating with said end wall aperture, said slot presenting an opening for insertion of said shaft therethrough, said slot guiding said shaft to said end wall aperture for reception of said shaft therein, whereby to releasably mount said end walls to said shaft.

* * * * *